US007650285B2

(12) United States Patent
Magliaro et al.

(10) Patent No.: US 7,650,285 B2
(45) Date of Patent: Jan. 19, 2010

(54) METHOD AND SYSTEM FOR ADJUSTING DIGITAL AUDIO PLAYBACK SAMPLING RATE

(75) Inventors: Max Magliaro, Philipsburg, PA (US); Gary Panulla, Bellefonte, PA (US)

(73) Assignee: Numerex Corporation, Atlanta, GA (US)

( * ) Notice: Subject to any disclaimer, the term of this patent is extended or adjusted under 35 U.S.C. 154(b) by 819 days.

(21) Appl. No.: 10/877,354

(22) Filed: Jun. 25, 2004

(65) Prior Publication Data

US 2006/0009983 A1 Jan. 12, 2006

(51) Int. Cl.
*G10L 19/00* (2006.01)

(52) U.S. Cl. ..... 704/500

(58) Field of Classification Search ..... 704/500
See application file for complete search history.

(56) References Cited

U.S. PATENT DOCUMENTS

| | | | | |
|---|---|---|---|---|
| 5,821,986 | A | 10/1998 | Yuan et al. | |
| 6,434,606 | B1 | 8/2002 | Borella et al. | |
| 6,658,027 | B1 | 12/2003 | Kramer et al. | |
| 6,862,298 | B1 | 3/2005 | Smith et al. | 370/516 |
| 2002/0126707 | A1 | 9/2002 | Tong et al. | |
| 2002/0191107 | A1 | 12/2002 | Hu et al. | |
| 2003/0012138 | A1 | 1/2003 | Abdelilah et al. | 370/231 |
| 2003/0043784 | A1 | 3/2003 | Selin | 370/352 |
| 2003/0182336 | A1* | 9/2003 | Nielsen et al. | 708/300 |
| 2004/0019491 | A1 | 1/2004 | Rhee | |
| 2004/0156622 | A1* | 8/2004 | Kent et al. | 386/96 |
| 2005/0089148 | A1* | 4/2005 | Stokes et al. | 379/3 |

FOREIGN PATENT DOCUMENTS

| | | |
|---|---|---|
| WO | WO 96/14711 | 5/1996 |
| WO | WO 2006/011867 A1 | 2/2006 |

OTHER PUBLICATIONS

International Search Report dated Jun. 20, 2005 for PCT/US04/20565.

Company Press Release; *New PictureTel 900 Series—Videoconferencing as it Should be, New iPower(TM) Architecture Delivers PC Foundation for New Generation of Integrated Collaboration Solutions*; Jul. 31, 2000; Press release previously located at http://biz.yahoo.com/bw/000731/ma_picture.html.

* cited by examiner

*Primary Examiner*—Richemond Dorvil
*Assistant Examiner*—Jakieda R Jackson
(74) *Attorney, Agent, or Firm*—King & Spalding

(57) ABSTRACT

In a packet communication network, to compensate for rate mismatches between transmitting and receiving devices, an apparatus and method provides for adjusting the playback sampling rate and for monitoring the buffer. The receiving device will monitor its buffer; relevant buffer data can comprise whether the buffer is approaching capacity or approaching depletion and the speed in which the buffer is approaching capacity of approaching depletion. The receiving device will then trigger an adjustment to the playback sampling rate to attune the rates of the transmitting and receiving devices or to compensate for jitters from any number of network complications. The receiving device may also store the buffer data for later action, for example, to formulate specific adjustment procedures or to compile specific conference profiles. The present invention may function alone or function in conjunction with other known methods in the art.

37 Claims, 6 Drawing Sheets

METHOD AND SYSTEM FOR ADJUSTING DIGITAL AUDIO PLAYBACK SAMPLING RATE

RELATED APPLICATION

The present application references and incorporates herein a related U.S. application entitled Method and System for Dynamically Adjusting Video Bit Rates, filed on Nov. 13, 2001, and assigned Ser. No. 10/008,100.

FIELD OF THE INVENTION

The present invention relates to data transmission of streaming data. The invention particularly provides a method and system for controlling the playback rate of real-time audio data received over a network.

BACKGROUND OF THE INVENTION

A telephony application enables transmission of real-time audio data over a packet-based network. To name a few, applications include voice over private Internet Protocol (IP) backbones, Internet or intranets, messaging, and streaming audio play, such as music or announcements. The most popular application is IP Telephony, that is, any telephony application that enables voice transmission via Internet Protocol (VoIP). This technology allows a device to transmit voice as just another form of data over the same IP network. For the purposes of this patent application, we also consider the audio transmissions in a video conference to be a form of IP Telephony. IP Telephony comprises numerous applications that support connections such as PC-to-PC connections, PC-to-phone connections, and phone-to-phone connections.

The crux of VoIP lies in converting an analog signal to digital IP packets (A/D), transmitting the IP packets over a network, and converting the IP packets back into a playable analog signal (D/A). At the transmitting end, a device generally digitizes the signal at a specific sampling rate, encodes that digital data into frames, converts the frames into IP packets, and transmits the IP packets over an IP network. At the receiving end, a device typically receives the packets, extracts the digital data from the packets, and converts the digital data into analog output at the same sampling rate as that used by the transmitter.

VoIP has both advantages and disadvantages when compared with traditional (e.g. PSTN) digital telephony systems. As for the advantages, the technology operates on the existing infrastructure, utilizing PSTN switches, customer premises equipment, and Internet connections. IP Telephony also improves the efficiency of bandwidth use for real-time voice transmission. And of particular interest, IP Telephony offers a new line of applications, combining real-time voice communication and data processing.

Regarding the disadvantages, VoIP and packet communication introduce issues of "reassembling" the packets, that is, playing the packets as if the packets were the original, continuous analog signal. Playing the IP packets appears simplistic; the receiving station could, upon receiving IP packets, convert the IP packets to an analog signal and immediately play the analog signal. Playing the packets upon reception, however, would resemble an accurate reconstruction only if the sender transmits the packets at uniform intervals, the packets transfer through the network without inconsistent delay, and the packets successfully reach the receiver. Each of these premises are often false. At times, starvation periods exist where the receiver has no packet to play, and at other times, burst periods overwhelm the receiver with too many packets to play. This non-uniformity is generally referred to as "jitter."

Accordingly, to account for this "jitter," most applications employ a buffer. A buffer loads incoming packets or frames to allow the receiver to retrieve and play the packets or frames at a uniform rate. The number of frames or packets in the buffer can fluctuate up and down with the network jitter. As long as the buffer never empties or overflows, the receiver will be able to play at its uniform rate, without audio disturbances. This buffering technique exists in most real-time media systems that receive audio or video from a network.

The buffer, however, cannot account for inconsistent sender transmission rate and receiver playback rate (or buffer output rate). In traditional digital telephony systems, a master clock synchronizes end points to ensure that the D/A and A/D converters at both ends operate at identical sampling rates. Identical sampling rates ensure that, on average, the data transmission rate will equal the receiver output rate. In contrast, in IP Telephony, no master clock exists to synchronize the sampling rates. In VoIP systems, it is common to employ personal computers, or similar hardware, with sound cards that have inaccurate sampling rates. Sound cards set at 8000 samples per second, for example, can actually have sampling rates that vary between 7948 and 8130 samples per second. For PC-based VoIP and videoconferencing systems, the clocks are not necessarily accurate enough to guarantee identical sampling rates. As a result, a receiver that operates at a slightly higher sampling rate will playback data faster than the sender transmits the data, ultimately emptying the buffer and requiring the receiver to play periods of "silence." A receiver that operates at a slightly lower sampling rate will play data slower than the sender transmits the data. With the receiver steadily falling behind, the data will ultimately overwhelm the buffer, requiring the receiver to "discard" periods of playback data (frames or packets). Increasing the buffer size fails to remedy the problem because the concomitant delay between transmission and actual playback becomes unacceptable for real-time audio transmission.

A common solution is to insert "silent" periods when the buffer approaches depletion and to remove "silent" periods when the buffer approaches capacity. This solution has numerous flaws. From a hardware perspective, problems include detecting periods of silence and handling the requisite additional processing. From a user perspective, any inserting or deleting "silent" periods degrades the conversation, as no true periods of silence exist in VoIP applications. Therein lies the rub: the inherent difference between the human eye and ear. While a video frame may be left on display a split second longer than the next frame without human detection, a tone cannot simply be left playing. Accordingly, the prior art focuses on inserting sound periods or removing sound periods, seemingly the only suitable way to manipulate the flow rate of audio data in a real-time environment. See, e.g., U.S. Pat. No. 6,658,027 ("Jitter Buffer Management").

The forgoing illustrates that during real-time audio transmission over a network a need exists to continually monitor the buffer and adjust the playback rate of a receiver to account for variances in sampling rates among transmitters and receivers.

SUMMARY OF INVENTION

The present invention provides a method and system for data transmission of streaming data. More specifically, the invention provides a method and system for controlling a receiver's playback sampling rate when playing data that was sent over a network. In an exemplary embodiment, a transmitter converts analog data to digital data at a transmitter's sampling rate, places the data in packets, and sends the packets over a packet-based network. The receiver receives the packets, forwards the packets to a buffer, monitors the buffer, and converts the packets for playback at the receiver's playback sampling rate. In this exemplary embodiment, as with many telephony applications, the sender and receiver apparatuses utilize separate clocking mechanisms for analog to digital or digital to analog conversion. Imperfections in hardware create variations in these sampling rates, and thus, ultimately create variations in transmission and playback rates. The present invention solves the above problem by providing a system and method for monitoring a receiver's buffer and adjusting the receiver's playback sampling rate to maintain an adequate number of packets in the buffer; this accounts for sampling rate variations among the apparatuses.

In one aspect, an exemplary embodiment is a receiver apparatus that comprises an interface for receiving packets from a packet-based network, a buffer for temporarily storing the data packets, a buffer monitor, a digital to analog converter for converting the digital data to an analog signal, and a clocking mechanism operable to provide the digital to analog converter with different frequencies. The interface can employ any means to communicate over any type of packet-based network. The present invention can serve as a supplement to current buffering techniques or can operate independently. Additionally, techniques of communication and data compression have no effect on the present invention, and the present invention can incorporate all such techniques, such as utilizing frames and encoding schemes. Those of ordinary skill in the art will also appreciate that the present invention can be implemented over any network.

Turning back to the exemplary receiver, the buffer monitor queries the buffer to determine the buffer's activity. Generally, querying the buffer's activity entails determining the number of packets in the buffer, but might also entail determining other activity such as rates at which the buffer's capacity changes. In accord with this exemplary embodiment, if the buffer approaches capacity or depletion, the buffer monitor can trigger changes in the playback sampling rate of the receiver. Typically, a clocking mechanism provides a frequency to the digital to analog converter, and adjusting that frequency adjusts the playback sampling rate. The buffer monitor triggers adjustments to the playback rate to, in effect, synchronize the playback rate to the transmission rate. The degree of adjustment and the number of possible adjustments that can be made are endless. Typically, small adjustments are made that do not effect the sound quality, namely, between 0 and 4 Hz.

Exemplary receiver and transmitter apparatuses may exist as a personal computer, laptop, phone, cellular phone, or any other device that includes a buffer, buffer monitor, digital to analog converter, and an interface to the incoming data. The components of the apparatus (buffer, buffer monitor, etc.) can be separate modules or exist in combination. An exemplary implementation, for example, can be on sound cards in conjunction with a personal computer that has an interface, either directly or indirectly, to a packet-based network.

In another aspect, a method provides for real-time audio communication sessions where a transmitter sends audio digital data; a receiver receives the digital data, monitors its buffer, and optionally adjusts the playback rate; and the receiver plays the audio data at the receiver's playback rate. In this exemplary embodiment, with each incoming packet, the receiver can query the buffer to determine the number of packets in the buffer, update a variable representing the sum of the queries, and update a variable representing the number of incoming packets (number of queries here). Accordingly, at any point, the buffer monitor can calculate the average number of packets in the buffer with these two variables. The buffer monitor can then adjust the playback rate. Alternately, in another aspect, a transmitter sends audio digital data in any digital format, and the receiver or an interface can format the digital data for buffering in accordance with the present invention.

In an exemplary embodiment, the buffer monitor allows a ten second initiation period to elapse before monitoring the buffer. Then, the buffer monitor calculates the average number of packets in the buffer every 20 seconds, and adjusts the playback rate if the average is too high or too low. In this exemplary embodiment, the buffer monitor adjusts the playback rate more dramatically if the average is dangerously high or low, adjusts the playback rate less dramatically if the average is near satisfactory conditions, and does not adjust the playback rate if the average falls in a satisfactory zone.

Accordingly, by monitoring the buffer and adjusting the playback sampling rate, the present invention remedies the problem of varying sampling rates among devices communicating audio data over a network.

DETAILED DESCRIPTION

Figure 1:
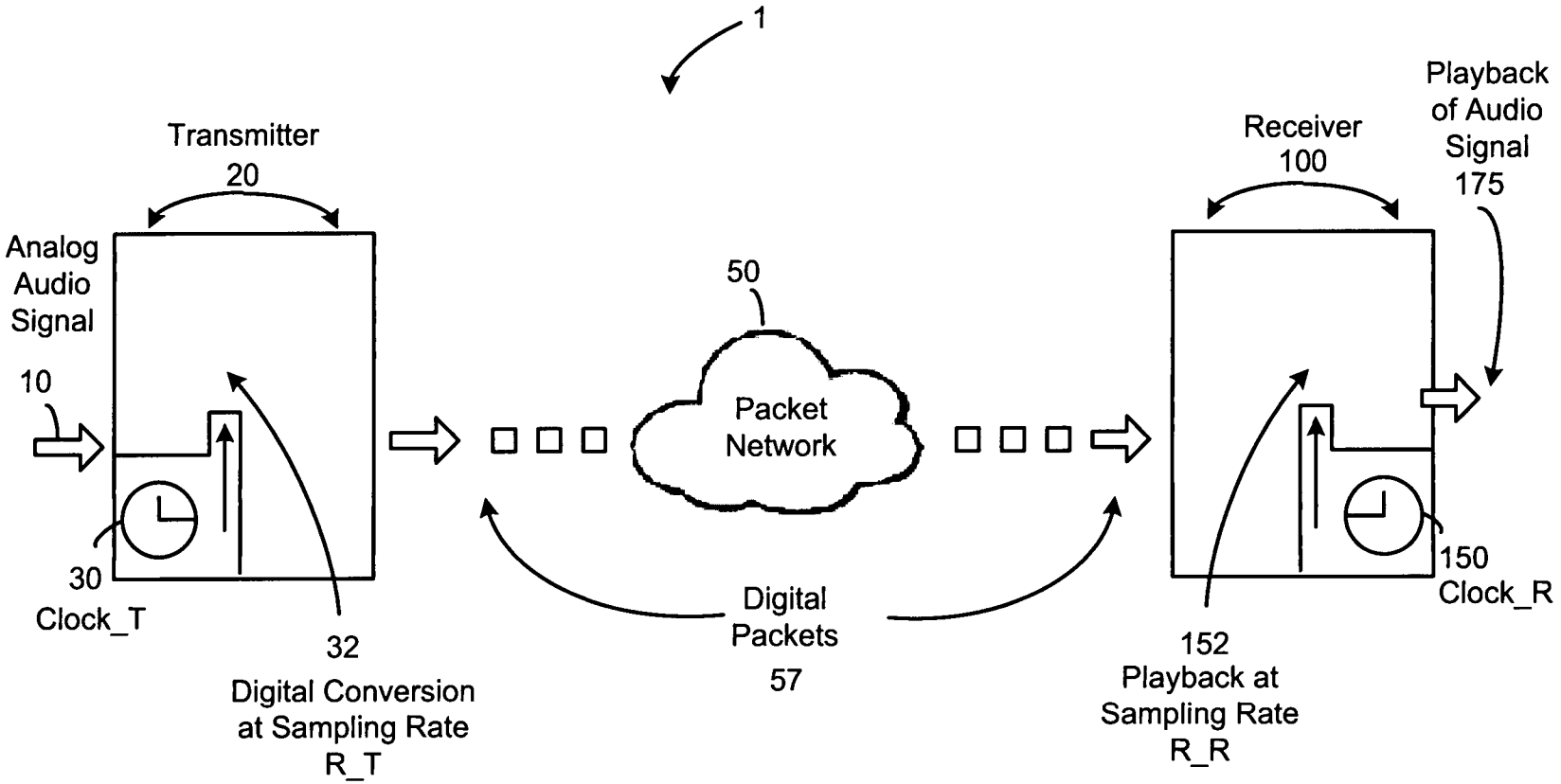
FIG. 1 depicts a network in which a transmitter and receiver communicate via real-time audio data transmission in accord with an exemplary embodiment of the invention.

The present invention entails real-time transmission of audio data over a network. FIG. 1 illustrates an exemplary environment 1 for operation of the present invention. More specifically, FIG. 1 illustrates a packet-based network 50 in which a transmitter 20 and receiver 100 communicate via real-time audio data transmission. While the present invention can operate over any network, for clarity, the following description of the exemplary embodiments of the invention will focus on packet-based networks, such as the Internet network. Similarly, the transmitter 20 can operate as a receiver, and the receiver 100 can operate as a transmitter. Again, the following description also addresses systems with a single, direct voice terminal for convenience, but one can implement the invention with multiple, indirect voice terminals.

Referring to FIG. 1, live audio data 10 feeds into a transmitter 20, which digitizes the analog signal. The transmitter 20 digitizes the signal at sampling rate 32 according to a frequency originating from a local clock 30. The transmitter sends the digital data in digital packets 57 over the packet-based network 50 to the receiver 100. The receiver 100 converts the digital signal into an analog signal for playback 175 at playback sampling rate 152 according to a frequency originating from a local clock 150. The receiver 100 is able to increase or decrease the playback sampling rate 152. The two sampling rates 32 and 152 originate from different clocks that have different local frequency references, 30 and 150 respectively. And as the Background of the Invention explains, the sampling rates of transmitter 20 and receiver 100 may vary due to inherent hardware imperfections.

Figure 2:
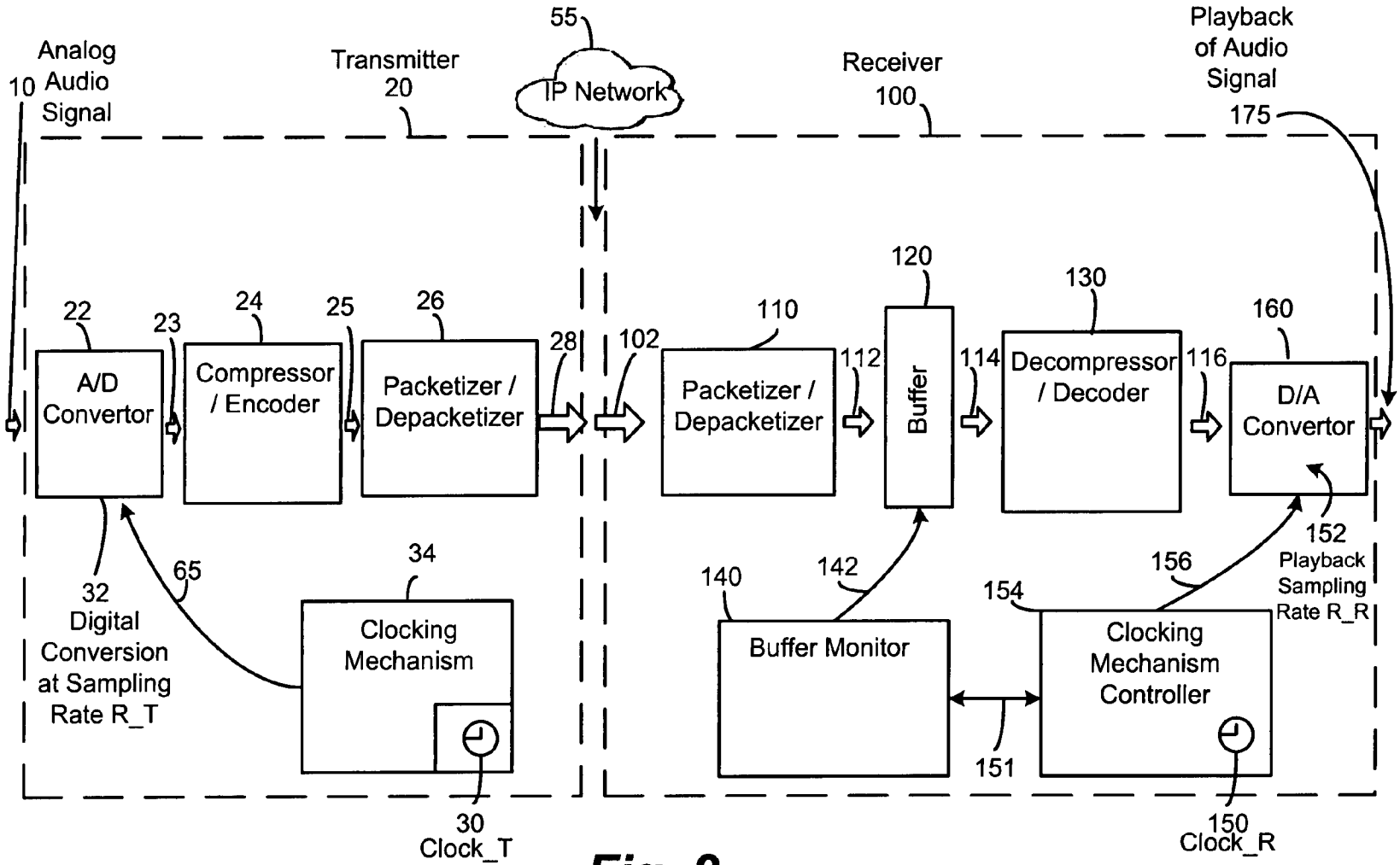
FIG. 2 illustrates a transmitter and receiver operable to communicate in real-time via voice over Internet transmission in accord with an exemplary embodiment of the invention.

FIG. 2 illustrates the components of exemplary environment 1 in greater detail. More specifically, FIG. 2 illustrates exemplary transmitter 20 and receiver 100 operable to communicate in real-time via audio data transmission over the Internet network 55 in accord with one embodiment of the invention. Referring to FIG. 2, the receiver 100 accounts for the potential difference between the sampling rate 32 of the transmitter 20 and sampling rate 152 of the receiver 100 by monitoring the buffer 120 of the receiver 100 and adjusting the playback sampling rate 152 of the receiver 100. Transmitter 20 receives an analog audio signal 10. The transmitter 20 comprises hardware to digitize the analog signal 10 for packet transmission. Transmitter 20 can have an analog to digital converter 22, such as a CODEC, and can have a clocking mechanism 34 that provides a frequency to the analog to digital converter via port 65. Port 65 can be any means for providing a clocking frequency to the analog to digital converter. The Transmitter can comprise compressor/encoder hardware or software 24 to perform such functions as compressing the data and framing the data. Common voice coding techniques include G.711, G.726, G.728, G.729, and G.723.1. Accordingly, the data, in one exemplary embodiment, can travel from the A/D converter 22 as a PCM signal (Pulse Code Modulated) 23, and travel from the compressor/encoder 24 to the packetizer/depacketizer 26 as digital frames 25. The packetizer 26 ultimately structures the data into packets in accordance with a known IP protocol for transmission over the IP network 55. The Transmitter 20 comprises an interface 28 to the IP network. The interface 28 can communicate with the receiver 100 according to any communication method 102 and can comprise any attendant hardware or software to implement the communication method 102. A software interface 28, for example, may initiate a socket connection with the receiver 100.

Again referring to FIG. 2, the receiver 100 comprises a buffer 120, buffer monitor 140, and a clocking mechanism 154 that operates independent from the transmitter's clocking mechanism 34. Communication ports 142 and 151, respectively, couple the buffer monitor 140 to the buffer 120 and the clocking mechanism 154. The receiver 100 receives the packets over the IP network 55; the receiver 100 can implement any type of interface 28 to receive the packets. The packetizer/depacketizer 110 can unpack the IP packets into frames or simply forward the packets to the buffer 120. The digital data 112 can thus exist as a known format of frames, a proprietary format, or any form of packets. The term packet will herein incorporate all such formats for clarity.

Packets arrive non-uniformly due to jittering from the network 55. A jitter buffer is well know in the art, and the present invention can supplement all such buffering techniques. The buffer monitor 140 monitors the activity of the buffer. Typically, monitoring the buffer's activity entails querying the buffer 120 to determine the number of packets in the buffer 120, but can also entail determining the rate at which the buffer 120 is filling or emptying, the rate at which packets are entering the buffer 120, or any other activity regarding the packets in relation to the buffer 120. The buffer monitor 140 is operable to trigger an adjustment to the playback sampling rate 152 when the buffer monitor 140 determines the buffer 120 satisfies certain criteria. The buffer monitor can query the buffer through port 142, which may be any physical means for monitoring the buffer, including software and hardware-only implementations. When the monitor 140 determines the buffer 120 satisfies said criteria, the monitor 140 communicates with the clocking mechanism 154 through port 151, directing the clocking mechanism 154 to adjust the playback sampling rate 152. Exemplary clocking mechanism 154 is operable to adjust the playback sampling rate in relatively small intervals. For example, the buffer monitor 140 preferably can trigger an 8 Hz increase in the playback sampling rate, and the receiver 100 then preferably can increase the playback rate in an increment of approximately 8 Hz. Playback devices vary with respect to their accuracy in altering their playback sampling rates. When the buffer monitor 140 triggers an increase or decrease in playback sampling rate, the actual adjustment to the playback sampling rate may not be identical to the adjustment that the buffer monitor 140 triggers. Exemplary clocking mechanism 154 can send clocking frequencies through port 156 to the digital to analog converter 160.

As FIG. 2 illustrates, the receiver 100 continuously converts the incoming data via an optional decompressor/decoder 130 and digital to analog converter 160 at sampling rate 152. The receiver 100 can implement any techniques of encoding or jitter buffering in accordance with the present invention. Techniques, therefore, can manipulate the data 114 leaving the buffer 120 via the decompressor/decoder 130, or can manipulate the data as the data 116 leaves the decompressor/decoder 130. Those of ordinary skill in the art will appreciate the modules above may exist as separate modules or may exist as one module which can remove any need of separate ports 65, 142, 151, and 156.

Figure 3:
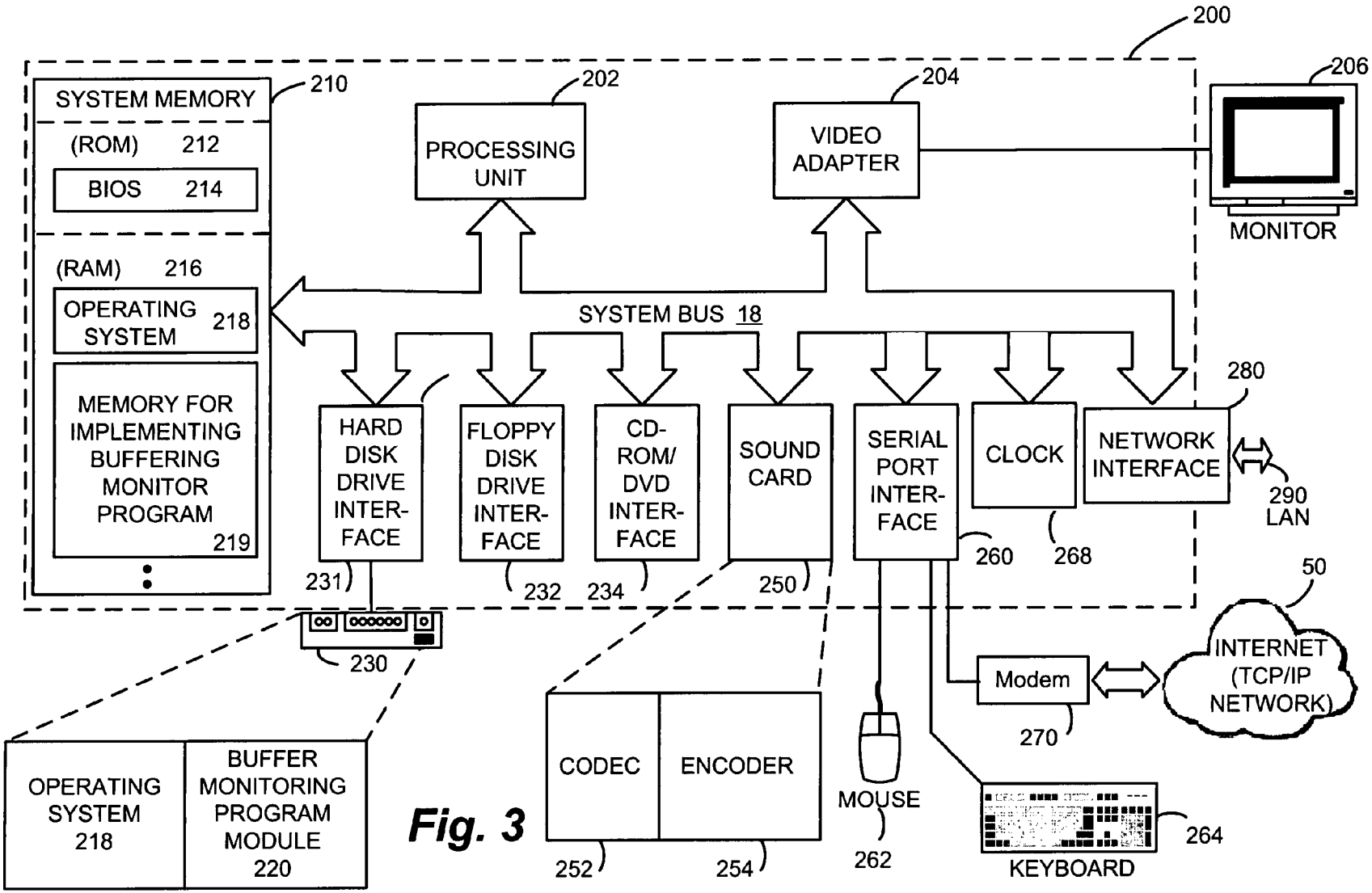
FIG. 3 represents a personal computer which can function as a receiver or transmitter in accord with an exemplary embodiment of the invention.

FIG. 3 illustrates a conventional personal computer 200 suitable for functioning as a receiver 100 or transmitter 20 in accord with an exemplary embodiment of the invention. Any device, however, that comprises a buffer, buffer monitor, and variable clocking mechanism can implement the present invention. Examples include laptops, phones, cellular phones, and handheld devices. Referring to FIG. 3, the exemplary personal computer 200 can operate in a network environment, including local area networks 290 and wide area networks 50. The exemplary personal computer 200 comprises a processing unit 202, such as "PENTIUM" microprocessors, manufactured by Intel Corporation. The exemplary personal computer 220 also includes system memory 210, including read only memory (ROM) 212 and random access memory (RAM) 216, which is connected to the processor 202 by a system bus 18. The exemplary personal computer 200 utilizes a BIOS 214, which is stored in ROM 212. Those skilled in the art will recognize that the BIOS 214 is a set of basic routines that helps to transfer information between elements within the exemplary personal computer 200. Those skilled in the art will also appreciate that the present invention may be implemented on computers having other architectures, such as computers that do not use a BIOS, and those that utilize other microprocessors.

Within the exemplary personal computer 200, a hard disk drive interface 231 connects the local hard disk drive 230 to the system bus 18. A floppy disk drive interface 232 and CD-ROM/DVD interface 234 can connect floppy disk drives (not shown) and CD-ROM devices (not shown) to the system bus 18, such as an Industry Standard Architecture bus (ISA). A user enters commands and information into the exemplary personal computer 200 by using input devices, such as a keyboard 264 and/or pointing device, such as a mouse 262, which are connected to the system bus 18 via a serial port interface 260. Other types of pointing devices (not shown in FIG. 1) include track pads, track balls, pens, head trackers, data gloves and other devices suitable for positioning a cursor on a computer monitor 206. The monitor 206 or other kind of display device can connect to the system bus 18 via a video adapter 204. Although other internal components of the personal computer 200 are not shown, those of ordinary skill in the art will appreciate that such components and the interconnection between them are well known. Those of ordinary skill in the art also will appreciate the modules and hardware in FIG. 3 can exist as separate modules and hardware pieces or can exist in many different forms in which certain modules and hardware couple together as single modules or hardware pieces.

Additional details regarding the internal construction of the exemplary personal computer 200 focus on aspects pertinent to the present invention. Referring to FIG. 3, the exemplary personal computer 200 includes a sound card 250 that comprises a digital to analog converter, such as a CODEC 252, and an encoder 254. The buffer monitor 140 can exist as a computer program module 220 residing on the hard drive 230 that utilizes the RAM 216 to implement its functioning. The buffer monitor program 220 can access the soundcard via ISA bus 18. The sound card 250 can connect to the personal computer 200 via a serial port interface 260, connect via the ISA bus 18, or connect via direct incorporation on the motherboard. A clock 268 forms part of the clocking mechanism 154.

The exemplary personal computer 200 can connect to networks via a network interface 280, such as local area networks 290, which can provide indirect connection to wide area networks. The exemplary personal computer 200 also can comprise a modem 270 for direct communication over packet networks. In the case of an exemplary transmitter 20, the real-time audio signal 10 preferably transmits to the sound card 250 via a microphone or other device (not shown). The sound card 250 converts the data to digital packets which the sound card 250 feeds to the ISA 18 (the packets may directly trace on the mother board if the sound chip has a direct connection to the motherboard).

Figure 4:
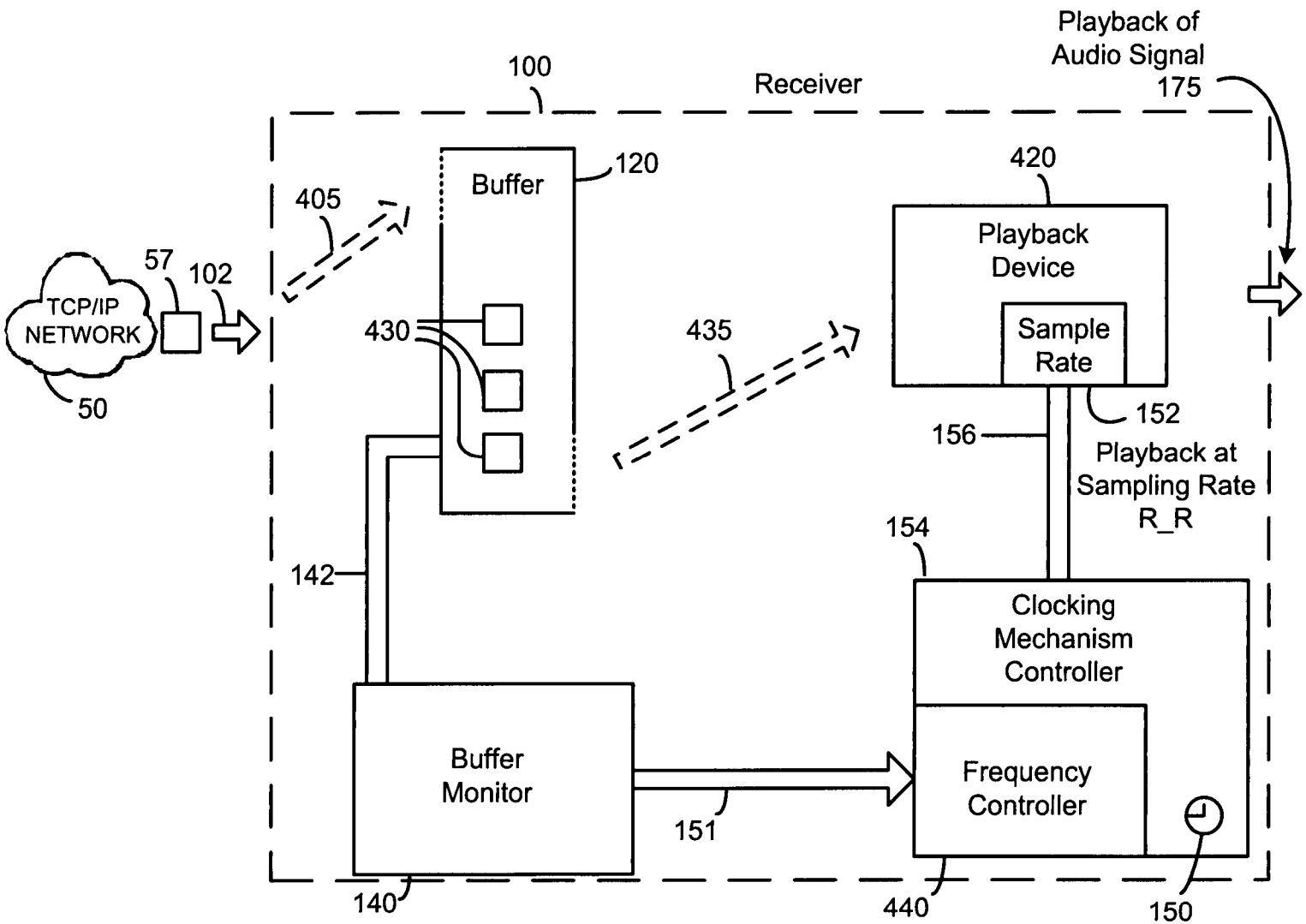
FIG. 4 depicts the flow of data through a receiver apparatus in accord with an exemplary embodiment of the invention.

FIG. 3 represents only one exemplary embodiment of the present invention. All the requisite components of the current invention may reside on the soundcard or may be spread out through the exemplary personal computer 200 or other device. FIG. 4 depicts the flow of data through an exemplary receiver 100 in accord with one embodiment of the present invention. The playback device 420 comprises the necessary hardware to convert the packets to an analog signal. Packets 57 enter the receiver 100 through interface 102 and then flow to the buffer 120 through a pathway 405. The buffer monitor 140 monitors the activity of the buffer 120 through port 142; this monitoring can be querying the number of packets 430 in the buffer 120. The playback device 420 continuously samples the data at sampling rate 152, and the data flows from the buffer 120 to the playback device 420 along pathway 435 at the rate in which the playback device 420 plays the data. When the activity of the packets 430 in the buffer 120 satisfy certain criteria, the buffer monitor 140 directs the clocking mechanism 154 through port 151 to adjust the playback sampling rate using frequency controller 440. The clocking mechanism 154 can send a clocking frequency to the playback device through port 156.

Port 151 from the buffer monitor 140 to the clocking mechanism controller 154 can be through any physical means, and the components of the buffer monitor and clocking mechanism can actually reside in a single module. Likewise, the port 142 from the buffer monitor to the buffer 120 can be through any means that allows the buffer monitor 140 to monitor the activity of the buffer 120, and the components of the buffer monitor 140 and the buffer 120 can form a single module. Finally, port 156 from the clocking mechanism 154 to the playback device 420 can also assume any form to provide a frequency to the playback device 420, and the clocking mechanism 154 may be part of the playback device module 420.

Figure 5:
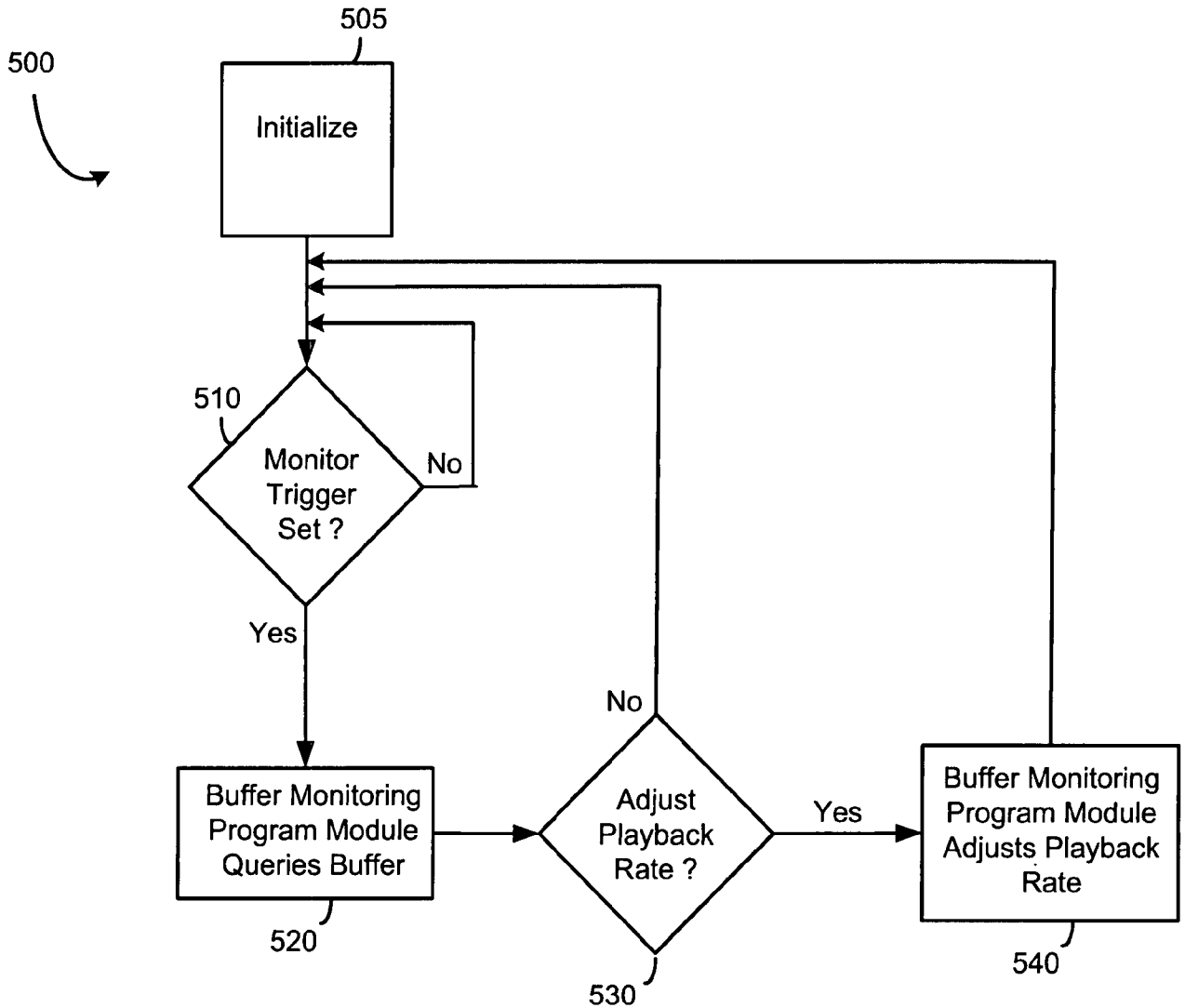
FIG. 5 is a flowchart of monitoring the buffer and adjusting the playback sampling rate in accord an exemplary embodiment of the invention.

FIG. 5 illustrates an exemplary process 500 for monitoring the buffer and adjusting the playback sampling rate process in accord with an exemplary embodiment of the invention. The process begins at the initialize procedure in step 505, whether automatic triggering per a communication initiation, automatic triggering per an independent program monitoring the performance of the communication, or manual triggering. The buffer monitor 140 determines whether the monitor trigger is set in step 510. If the monitoring trigger is set, the buffer monitoring program module 220 queries the buffer 120 in step 520. When the buffer monitoring program module 220 queries the buffer 120, the buffer monitoring program module 220 can determine the number of packets in the buffer 120, determine the rate at which the buffer is filling or emptying, or use any other monitoring method to determine the buffer's activity. In step 530, the buffer monitoring program module 220 decides whether the playback rate 152 should be adjusted. If an adjustment is not made, the process 500 loops back to the step of determining whether the monitor trigger is set in step 510. If the buffer monitoring program module 220 decides to adjust the playback rate 152, it sends an communication to the clocking mechanism 154.

Figure 6:
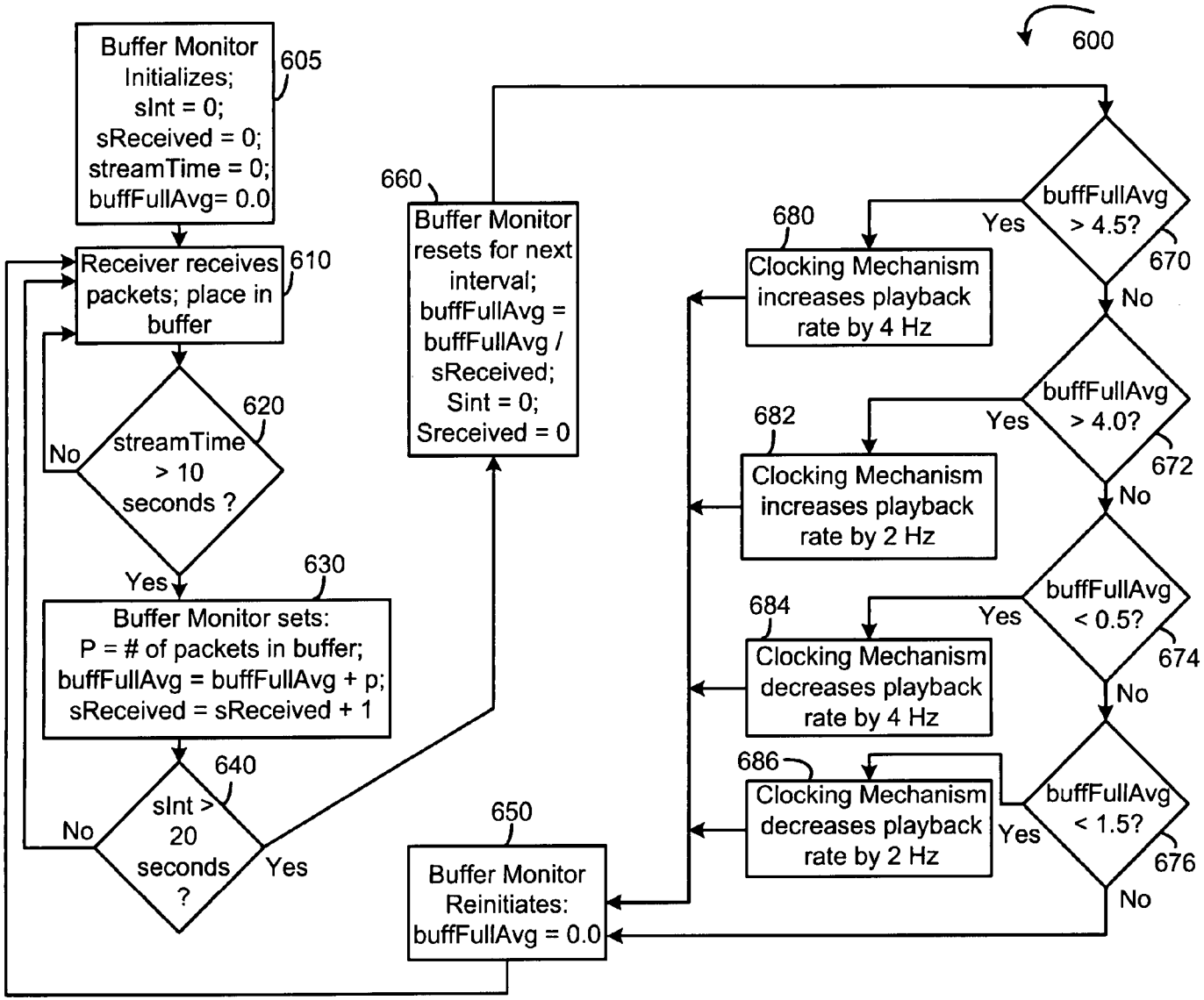
FIG. 6 is a flowchart of monitoring the buffer and adjusting the playback sampling rate according to an exemplary embodiment of the invention.

FIG. 6 illustrates exemplary process 600 for monitoring the buffer and adjusting the playback sampling rate according to the preferred embodiment of the present invention. The variables have the following definitions. "streamTime" represents the total time that the data stream has been running. The invention can idle for this period of time after initiation to account for typical sporadic variations that occur as the transmitter and receiver establish a connection. This period approximates 10 seconds in exemplary process 600. "sInt" represents the running time from when the last decision was made to determine whether to adjust the playback rate. The preferable period for this variable is 20 seconds in exemplary process 600. "sReceived" represents the number of instances of receiving a packet and querying the buffer. "buffFullAvg" represents the average number of packets in the buffer over the last sInt interval of time.

Referring to FIG. 6, the exemplary process 600 starts with the buffer monitor 140 initializing the variables in step 605, and exemplary process 600 can trigger according to any number of events. The receiver 100 receives a packet in step 610 and places the packet in the buffer 120. An initial loop between steps 610 and 620 then occurs until the streamTime elapses. After streamTime elapses at step 620, exemplary process 600 loops through steps 610, 620, and 630 until sInt time elapses at step 640. At step 630, the buffer monitor 140 queries the buffer's activity 120, tallying the number of packets in the buffer and tallying the number of packets received. At step 640, the process will loop back to step 610 unless sInt has elapsed.

Once sInt elapses at step 640, the buffer monitor 140 calculates the average number of packets in the buffer for that sInt period and re-initializes the variables at step 660. The process then turns to steps 670 to 686 to determine whether to adjust the playback sampling rate. At step 670, if buffFullAvg>4.5, the buffer monitor 140 instructs the frequency controller 440 to increase the playback rate by 4 Hz at step 680. If not, proceeding to step 672, if buffFullAvg>4.0, the buffer monitor 140 increases the playback rate by 2 Hz at step 682. If not, proceeding to step 674, if buffFullAvg<0.5, the buffer monitor 140 decreases the playback rate by 4 Hz at step 682. If not, proceeding to step 676, if buffFullAvg<1.5, the buffer monitor 140 decreases the playback rate by 2 Hz at step 682. Whether or not an adjustment is made, the buffer monitor 140 reinitializes buffFullAvg at step 650 and returns to step 610.

FIG. 6 illustrates the ability to adjust the playback sampling rate to a greater degree when the buffer approaches extreme danger areas (example, less than 0.5 packets full or more than 4.0 packets full, on average). The exemplary process 600 adjusts the rate twice as many Hz as the first adjustment upon detecting a danger area. The invention can entail a greater number of variant adjustments and a manifold range of adjustment. Likewise, one can easily change the range of no action, i.e., where no adjustment is made, in FIG. 6 between 1.5 and 4.0 Hz.

As an illustration, taking sound cards capable of adjusting their playback sampling rate in increments of 2 Hz, a nominal 22050 Hz sampled stream typically will playback at anywhere from 22048 to 22056 Hz. This error range implies a possible 8 Hz variation between the sender and the receiver. Assuming a typical 5-packet buffer, and assuming typical packets that each represent about 60 mSec of actual time, a positive 8 Hz sampling error would result in the receiver playing each packet in about 59.98 mSec (error of 0.02 mSec with each packet the transmitter sends and the receiver plays). Thus, after receiving 3000 packets (three minutes), the receiver would gain a whole packet's worth of time (3000 packets*0.02 mSec), that is, the receiver would play the 3000 packets in the time it took the sender to send 2999 packets. Were the receiver to start with 3 packets in its buffer, the above error indicates that about every 9 minutes the buffer would empty. The emptying causes a "blank spot" in the audio on the receiving end. Thereafter, a "blank spot" or interruption would accompany practically every packet, because no buffer remains to cushion the 0.02 mSec error. The receiver would finish playing a packet 0.02 mSec before the next packet arrives. In practice, a 0.02 mSec "blank spot" may be a short interval that test subjects fail to notice. After 1000 packets (60 seconds), however, this error would accumulate to about 20 mSec, a "blank spot" that would prove quite noticeable.

In the converse case, where the receiver plays 8 Hz too slowly, the buffer progressively would fill. Were the buffer to have no size limitation, the buffer would accumulate a packet (60 mSec of data) every 3 minutes. After 30 minutes, the buffer would accumulate 10 packets (600 mSec of data), which represents more than a half second of delay. This delay would prove burdensome and annoying in strictly real-time voice communication. In a live media environment, with concurrent transmission of video and audio signals, this delay would prove disastrous because synchronization of the signals is of critical import.

The buffer monitoring program module 220 can compensate for these variations by making adjustments to the playback sampling rate 152. This can be done in an exemplary embodiment of the invention where the receiver 100 typically makes one or two frequency adjustments within the first minute of operation, settles on a playback rate 152 between 22048 and 22056 Hz, and remains at single playback rate 152 for 10 hours or more.

The above embodiments are merely demonstrative of the scope of the present invention. Factors that will alter the above variables include the jitter buffer size, how often rate adjustments should be made, and how much disruption the adjustment creates for an individual user. While the foregoing embodiments discuss voice communication over a packet network as an example, the teachings described herein can also be applied to other instances where real-time audio data is transmitted over a network.

We claim:

1. An apparatus for facilitating real-time audio data communication over a data packet network comprising:

a data interface for receiving data packets from the data packet network;

a buffer, coupled to the data interface, for temporarily storing the data packets;

a digital to analog converter, coupled to the buffer, for converting digital audio data in the data packets to an analog signal;

a clocking mechanism, coupled to the digital to analog converter, for providing variable frequencies to the digital to analog converter; and a buffer monitor for monitoring the buffer's activity during the real-time audio data communication, wherein the buffer monitor adjusts the playback sampling rate when the buffer approaches a capacity trigger value or a depletion trigger value;

and wherein the buffer monitor has a buffer capacity such that:

if an average of the buffer capacity is greater than 90%, the playback sampling rate is increased by 4 Hz;

if the avenge of the buffer capacity is greater than 80%, the playback sampling rate is increased by 2 Hz;

if the average of the buffer capacity is less than 10%, the playback sampling rate is decreased by 4 Hz; and if the average of the buffer capacity is less than 20%, the playback sampling rate is decreased by 2 Hz.

2. The apparatus of claim 1, wherein the data packets comprise frames.

3. The apparatus of claim 1, further comprising an analog to digital converter.

4. The apparatus of claim 1, further comprising an encoder.

5. The apparatus of claim 1, wherein the buffer monitor is further operable for calculating the average number of data packets in the buffer.

6. The apparatus of claim 5, further comprising a digital signal processor.

7. The apparatus of claim 5, further comprising read-only memory or Flash memory for storing data.

8. The apparatus of claim 5, further comprising an interface to a Peripheral Component Interconnect slot of a personal computer.

9. The apparatus of claim 5, further comprising in interface to an Industry Standard Architecture bus of a personal computer.

10. The apparatus of claim 5, wherein the buffer monitor is a software application stored in the Read Only Memory in a personal computer.

11. The apparatus of claim 10, wherein further adjustments to the playback sampling rate range between 0.0 and 8.0 Hz.

12. The apparatus of claim 1, wherein the buffer monitor is further operable for:

calculating a plurality of averages for the number of data packets in the buffer after different periods; and determining an adjustment to the playback sampling rate based on the plurality of avenges.

13. The apparatus of claim 1, wherein the playback sampling rate is approximately 8000 Hz.

14. The apparatus of claim 1, wherein the data packet network comprises a TCP/IP network.

15. The apparatus of claim 1, wherein the data interface further comprises a socket interface for establishing socket connections.

16. The apparatus of claim 1, wherein the digital to analog converter resides on a sound card.

17. A system for facilitating real-time data networking of audio data over a network comprising:

a transmitter comprising:

an analog to digital converter for converting an analog audio signal to digital data;

a clocking mechanism for providing a frequency to the analog to digital converter that establishes the analog to digital converter's sampling rate; and an interface coupled to the analog to digital converter for transmitting the digital data over the packet network;

a receiver comprising:

an interface for receiving digital data transmitted over the packet network;

a digital to analog converter for converting the digital data to an analog signal;

a clocking mechanism for providing a frequency to the digital to analog converter that establishes the receiver's playback sampling rate, wherein the clocking mechanism provides varying frequencies to the digital to analog converter;

a buffer that temporarily stores the digital data; and a buffer monitor for:

querying the buffer for determining the buffer's capacity; and triggering an adjustment in the playback sampling rate such that:

if an average of the buffer capacity is greater tan 90%, the playback sampling rate is increased by 4 Hz;

if the average of the buffer capacity is greater than 80%, the playback sampling rate is increased by 2 Hz;

if the average of the buffer capacity is less than 10%, the playback sampling rate is decreased by 4 Hz; and if the average of the buffer capacity is less than 20%, the playback sampling rate is decreased by 2 Hz.

18. The system of claim 17, wherein the digital data comprise frames, and wherein the sender and the receiver further comprise encoders.

19. The system of claim 17, wherein the transmitter and the receiver are personal computers.

20. The system of claim 19, wherein the buffer monitor is a computer application that resides in the personal computer's hard drive.

21. The system of claim 17, wherein the buffer's capacity comprises the avenge amount of digital data in the buffer.

22. The system of claim 17, wherein the receiver and transmitter's sampling rates are approximately 8000 Hz.

23. The system of claim 22, wherein further adjustments to the playback sampling rate range between 0.0 and 10.0 Hz.

24. The system of claim 22, wherein the transmitter and the receiver communicate via sockets.

25. A method of adjusting playback sampling rate to facilitate real-time audio communication over a packet network comprising the steps of:

receiving packets at a network interface;

forwarding packets from the network interface to a buffer for temporary storage;

monitoring the buffer's capacity;

forwarding packets from the buffer to a digital to analog converter for conversion to an analog signal for playback at a sampling rate;

determining whether to adjust the playback sampling rate based on the buffer's capacity such that:

if an average of the buffer capacity is greater than 90%, the playback sampling rate is increased by 4 Hz;

if the average of the buffer capacity is greater than 80%, the playback sampling rate is increased by 2 Hz;

if the average of the buffer capacity is less than 10%, the playback sampling rate is decreased by 4 Hz; and if the average of the buffer capacity is less than 20%, the playback sampling rate is decreased by 2 Hz.

26. The method of claim 25, wherein the step of monitoring the buffer's capacity further comprises querying the buffer upon receiving each data packet.

27. The method of claim 25, wherein the step of monitoring the buffer's capacity further comprises querying the buffer upon receiving each data packet to determine the number of data packets stored in the buffer.

28. The method of claim 25, wherein the step of monitoring the buffer's capacity comprises the steps of:

upon receiving each data packet, querying the buffer to determine the number of data packets stored in the buffer;

updating a variable that sums the query results; and updating a variable that sums the number of packets received.

29. The method of claim 25, wherein the step of monitoring the buffer's capacity further comprises reporting data to a buffer monitor.

30. The method of 25, further comprising the step of determining the amount to increase or decrease the playback sampling rate according to the duration of time in which the buffer took to approach capacity or to approach depletion.

31. The method of claim 25, wherein the step of determining whether to adjust the playback sampling rate further comprises the step of determining an average number of packets in the buffer.

32. A method for adjusting a playback sampling rate of a receiver to compensate for variations in buffering, sampling, and clock accuracy during real-time audio communication sessions over a packet network comprising the steps of:

receiving packets over a packet network at a network interface;

forwarding the packets from the network interface to a buffer for temporary storage;

querying the buffer to determine the number of packets that are stored in the buffer;

summing the number of packets that are stored in the buffer;

summing the total number of packets received;

comparing the number of packets stored in the buffer to a capacity of the buffer; and determining whether to adjust the playback sampling rate according to the query results such that:

if the number of packets in the buffer is greater than 90% of the capacity of the buffer, the playback sampling rate is increased by 4 Hz;

if the number of packets in the buffer is greater than 80% of the capacity, the playback sampling rate is increased by 2 Hz;

if the number of packets in the buffer is less than 10%, of the capacity, the playback sampling rate is decreased by 4 Hz; and if the number of packets in the buffer is less than 20% of the capacity, the playback sampling rate is decreased by 2 Hz.

33. The method of claim 32, wherein if it is determined that the playback sampling rate is to be adjusted, playing an audio signal by converting the received packets at the adjusted playback sampling rate to an audio stream.

34. The method of claim 32, wherein the packets comprise frames, and the method further comprises the step of decoding the frames.

35. The method of claim 32, wherein the packet network comprises a TCP/IP network.

36. A method of transmitting audio data to a receiver comprising the step of:

transmitting audio data to the receiver in data packets wherein the receiver is operable for:

receiving the data packets at a network interface;

storing the data packets in a buffer;

determining an average number of data packets in the buffer;

comparing the average number of data packets to a capacity of the buffer; and determining a receiver's playback sampling rate for the audio data based on the average number of data packets in the buffer such that:

if the average number of packets in the buffer is greater than 90% of the capacity of the buffer, the playback sampling rate is increased by 4 Hz;

if the average number of packets in the buffer is greater than 80% of the capacity, the playback sampling rate is increased by 2 Hz;

if the average number of packets in the buffer is less than 10%, of the capacity, the playback sampling rate is decreased by 4 Hz; and if the average number of packets in the buffer is less than 20% of the capacity, the playback sampling rate is decreased by 2 Hz.

37. The method of claim 36, further comprising the steps of:

converting an analog signal to digital data at a transmitter's sampling rate; and placing the digital data in packets in accordance wit a packet network's protocols.

* * * * *